US009862395B2

(12) United States Patent
Nagrodsky et al.

(10) Patent No.: US 9,862,395 B2
(45) Date of Patent: Jan. 9, 2018

(54) SYSTEM AND METHOD FOR TESTING TRACK CIRCUITS

(71) Applicant: GENERAL ELECTRIC COMPANY, Schenectady, NY (US)

(72) Inventors: Nick Nagrodsky, Melbourne, FL (US); Jeffrey Fries, Lee's Summit, MO (US); Aric Weingartner, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 557 days.

(21) Appl. No.: 14/501,852

(22) Filed: Sep. 30, 2014

(65) Prior Publication Data

US 2016/0090113 A1 Mar. 31, 2016

(51) Int. Cl.
*B61L 1/18* (2006.01)
*B61L 23/04* (2006.01)

(52) U.S. Cl.
CPC ..... *B61L 23/04* (2013.01); *B61L 1/18* (2013.01); *B61L 1/184* (2013.01)

(58) Field of Classification Search
CPC ..... B61L 23/04; B61L 1/18; B61L 1/184
See application file for complete search history.

(56) References Cited

U.S. PATENT DOCUMENTS 2,930,887 A * 3/1960 Duteil ..... B61L 1/188 246/34 R
7,363,187 B2 * 4/2008 Winkler ..... B61L 21/04 246/146
2002/0190811 A1 * 12/2002 Sperber ..... H04B 3/143 333/28 R
2008/0296441 A1 * 12/2008 Anderson ..... B61L 23/044 246/121
2013/0261842 A1 * 10/2013 Cooper ..... B61L 15/0081 701/1
2013/0284859 A1 * 10/2013 Polivka ..... B61L 27/0055 246/34 R
2014/0042993 A1 * 2/2014 Nagel ..... H02P 3/14 323/223
2014/0263858 A1 * 9/2014 Hogan ..... B61L 1/187 246/125
2014/0350767 A1 * 11/2014 Fries ..... B61L 27/0077 701/23
2015/0179003 A1 * 6/2015 Cooper ..... B60L 3/10 701/31.4
2015/0307117 A1 * 10/2015 Noffsinger ..... B61L 23/044 246/121
2016/0075356 A1 * 3/2016 Kull ..... B61L 23/044 246/121

(Continued)

*Primary Examiner* — Jason C Smith

(74) *Attorney, Agent, or Firm* — Global Patent Operation; John A. Kramer

(57) ABSTRACT

A system includes a track system having a first rail and a second rail, a track activity detection circuit electrically connected to each of the first rail and the second rail, a track shunt circuit electrically connected to the first rail and the second rail, wherein the track shunt circuit is configured to selectively electrically connect the first rail and the second rail through a shunt. A method includes receiving an instruction to apply a shunt between a first rail and a second rail of a track system, and electrically connecting the first rail to the second rail through a controllable track shunt circuit.

21 Claims, 5 Drawing Sheets

(56) References Cited

U.S. PATENT DOCUMENTS

| | | | | |
|---|---|---|---|---|
| 2016/0090113 | A1* | 3/2016 | Nagrodsky | B61L 23/04<br>246/34 R |
| 2016/0096538 | A1* | 4/2016 | Bartek | B61L 23/00<br>246/28 R |

* cited by examiner

SYSTEM AND METHOD FOR TESTING TRACK CIRCUITS

TECHNICAL FIELD

The subject matter disclosed herein relates to systems and methods for testing track circuits.

DISCUSSION OF ART

Track circuits for railroad signals and crossings must be tested to ensure proper operation. The prior systems and methods for testing track circuits have required significant manual effort resulting in increased costs.

BRIEF DESCRIPTION

Presently disclosed is a system and method for testing track circuits. In an embodiment, the system comprises a track activity detection circuit electrically connected to each of a first rail and a second rail of a track system, and at least one track shunt circuit connected (e.g., electrically connected) to the first and second rails. The at least one track shunt circuit is configured to selectively electrically connect the first rail and the second rail through a shunt.

In some embodiments, the track system includes an electrically isolated track section having a first end and a second end, and the at least one track shunt circuit includes a first track shunt circuit connected to the first rail and the second rail adjacent the first end of the track section, and a second track shunt circuit connected to the first rail and the second rail adjacent the second end of the track section. In some embodiments, the track activity detection circuit is configured to detect vehicle presence on the track system by detecting an electrical connection between the first rail and the second rail. In some embodiments, the track activity detection circuit comprises a vital relay. In some embodiments, the track activity detection circuit comprises a vital relay configured to be in a non-operative state when the first rail is electrically connected to the second rail by a vehicle axle.

In some embodiments of the system, the at least one track shunt circuit comprises a relay. In some embodiments, the at least one track shunt circuit is electrically connected directly to the first rail and the second rail. In some embodiments, the at least one track shunt circuit is electrically connected to the first rail and the second rail through the track activity detection circuit. In some embodiments, the at least one track shunt circuit is electrically connected to the first rail and the second rail through an impedance coupler.

In some embodiments, the shunt has a fixed impedance while in other embodiments the shunt has an adjustable impedance. In some embodiments, the shunt has an impedance of no less than 0.06 ohms.

In some embodiments, the system further includes a controller configured to operate the at least one track shunt circuit to electrically connect or disconnect the first rail from the second rail in response to instructions received from an operator. In some embodiments, the controller is configured to adjust the track activity detection circuit in response to calibration instructions. In some embodiments, the system further includes a communications interface operable to receive instructions from a remote operator to control the at least one track shunt circuit in response to the instructions that are received. In some embodiments, the communications interface is further operable to communicate track activity detection status to the remote operator. In some embodiments, the communications interface is further operable to receive instructions to calibrate the track activity detection circuit. In some embodiments, the remote operator is an automated track testing system.

Also disclosed is a method that includes the steps of, at a controllable track shunt circuit, receiving an instruction from a remote operator to electrically connect a first rail to a second rail of a track system; and automatically establishing an electrical connection between the first rail and the second rail, with a shunt of the controllable track shunt circuit, responsive to the instruction that is received.

In some embodiments, the method further includes the step of automatically detecting the electrical connection between the first rail and the second rail with a track activity detection circuit, responsive to the instruction that is received. In some embodiments, the method further includes the step of automatically adjusting the track activity detection circuit responsive to the detected electrical connection between the first rail and the second rail.

In some embodiments, the method further includes the steps of automatically detecting the electrical connection between the first rail and the second rail when the shunt has a first impedance, with a track activity detection circuit, changing the impedance of the shunt to a second impedance, and automatically detecting the electrical connection between the first rail and the second rail when the shunt has the second impedance. In some embodiments, the method further includes the step of automatically adjusting the track activity detection circuit responsive to a difference between the detected electrical connection when the shunt has the first impedance and the detected electrical connection when the shunt has the second impedance.

In some embodiments, the method further includes the steps of automatically monitoring local environmental conditions and communicating the monitored conditions to the remote operator, and the remote operator automatically generating the instruction to electrically connect the first rail to the second rail of the track system responsive to a change in the monitored conditions. In some embodiments, the method further includes the step of the remote operator automatically generating the instruction to electrically connect the first rail to the second rail of the track system responsive to a predetermined monitoring schedule. In some embodiments, the method further includes the step of the remote operator automatically generating the instruction to electrically connect the first rail to the second rail of the track system responsive to input from an automated track testing system.

BRIEF DESCRIPTION OF THE DRAWINGS

Reference is made to the accompanying drawings in which particular embodiments and further benefits of the invention are illustrated as described in more detail in the description below, in which.

DETAILED DESCRIPTION

Figure 1:
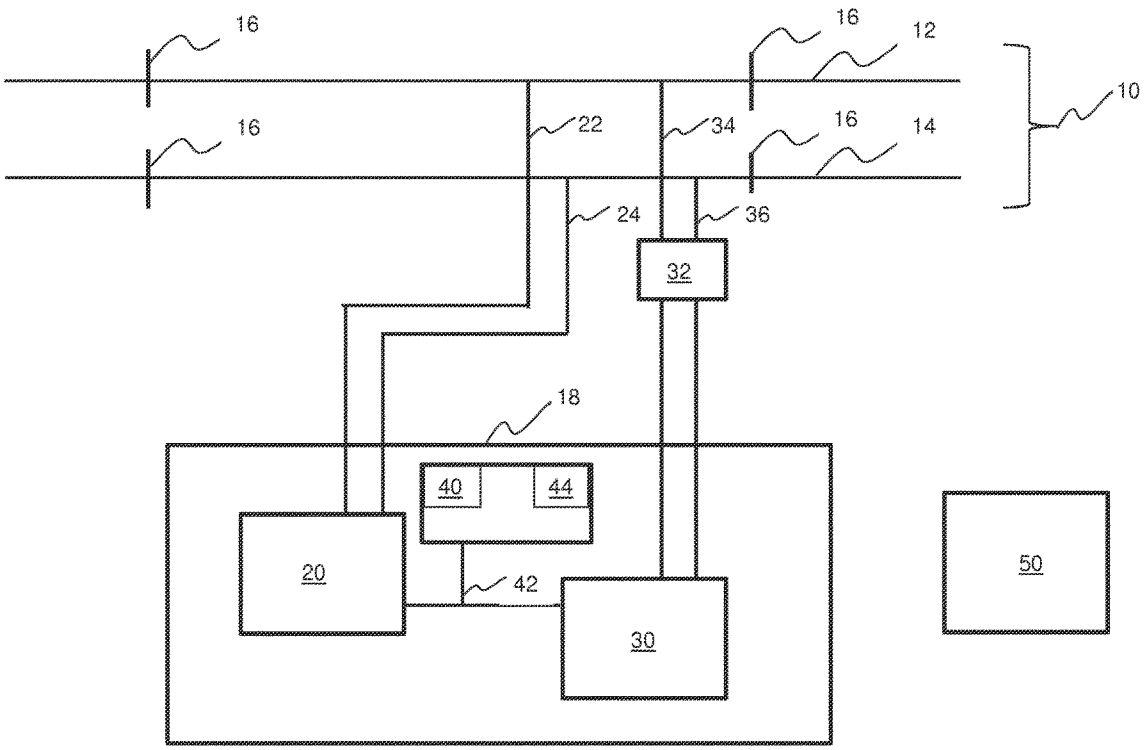
FIG. 1 is a schematic view of a track circuit testing system, according to an embodiment of the invention.

Embodiments of the subject matter disclosed herein relate to systems and methods for testing track circuits. The disclosed subject matter further relates to systems and methods for selectively applying a shunt to electrically connect the first rail and the second rail of a track system, and using the shunt to ensure proper operation of the track circuit. The shunt is controlled from a remote location that enables testing of the track circuit without a local operator present, thereby allowing for improvements in the track circuit testing process.

Railroad track systems include track circuits used for detecting the presence of vehicles on the track. The track circuit is formed by a track activity detection circuit connected to each of the pair of rails which comprise the railroad track system. As disclosed herein, the track activity detection circuit is configured to detect the presence of a vehicle, such as a rail car, on the track based upon the electrical connection formed between the rails through the vehicle's axle. Upon detection of a vehicle, the track circuit may activate appropriate systems such as railroad crossing signals appropriate to the location and situation that necessitate detecting the vehicle. In other embodiments, the track circuit may be used to trigger communication between wayside equipment and the locomotive.

Due to the importance of track circuits to the safe operation of the railroad, track circuits have been designed with fail-safe features. In some embodiments, a track system includes a vital relay that only permits signal systems to pass trains and only permits crossing gates and warning light systems to be in an off condition when the relay is operated. The vital relay will drop out of an operated position if a train is in the particular track section being controlled (as detected by the connection between the rails formed by the axle). The vital relay will also drop out of the operated position if there is a fault in the track circuit, with the result of stopping trains or activating crossing gates and warning light systems.

As used herein, a "shunt" refers to an electrical connection between the rails of the track systems, such as formed by the axle of a train or by a switchable electrical connection. In some embodiments, regulations require that the track circuit activate (i.e., identify the track as occupied by a vehicle) when a shunt is placed between the rails having an impedance of a defined value. In one example, a track circuit is configured to be responsive to a shunt having an impedance of no more than 0.06 ohms between the rails. The specific impedance value required for activating the track circuit may be related to regulations specifying the maximum impedance permitted between the rails as measured through the wheels and axle of a train. For example, a freight train may be required to have an impedance through the axles of no more than 0.06 ohms such that activation of the track circuit is guaranteed.

In various embodiments, a system is disclosed that includes a track activity detection circuit electrically connected to each of a pair of rails of a railroad track system, and configured to detect the presence of a vehicle, such as a train, on the track system. The system further includes at least one track shunt circuit connected to the pair of rails and configured to selectively electrically connect the first rail to the second rail through a shunt.

The disclosed system enables the placement of a shunt by remote operation, without requiring personnel to be physically present at the location where the shunt is to be placed. In this manner, significant cost savings may be achieved. In addition, methods of testing and monitoring track circuits are enabled that were not possible with previous systems.

In embodiments, elements of the system may be housed in a signal room or other wayside equipment housing located in proximity to a section of a track. For purposes of illustration and explanation, components of the system will be described as discrete elements, however the functions of the selected components may be implemented in one or more devices and may be combined or separated as desired in a given installation.

The track activity detection circuit is electrically connected to each of the rails of the track system. Using a vital relay or other fail-safe device, the track activity detection circuit is configured to detect vehicle presence on the track system by detecting an electrical connection between the rails of the track system. When a vehicle is present, the electrical connection is formed from a first rail, through the wheels and axle of the vehicle, to the second rail, which completes a portion of the track activity detection circuit and de-energizes the vital relay.

The at least one track shunt circuit is configured to selectively electrically connect the first rail to the second rail through a shunt. The track shunt circuit may be controlled to selectively (i.e., controllably) connect or disconnect the shunt in response to instructions as described further below. In some embodiments, the shunt is a relay, and may be a vital relay. In other embodiments, the shunt includes a switch and a resistor to provide a desired impedance between the rails. In order to present the desired impedance between the rails, the shunt has a desired impedance value. The impedance of the shunt may be characterized as the impedance as measured from the first rail to the second through the shunt, and any connections or wiring connecting the rails to the shunt. In some embodiments, the controllable shunt is provided in a shunt device (which is a portion of the track shunt circuit) located adjacent to the rails and controlled by a shunt controller located in a signal room. By locating the shunt device near the rails, the length of connecting wires may be reduced allowing for better control over the shunt impedance. In other embodiments, the shunt device may be located within the signal room (or other wayside equipment housing).

In an embodiment, the shunt is configured to have a fixed impedance. The fixed impedance may be determined by the test requirements of the track circuit. In one embodiment, the shunt has an impedance of not less than 0.06 ohms to comply with testing regulations for track circuits. In other embodiments, the shunt may have an adjustable or variable impedance. For example, the shunt may include an adjustable resistor so that different impedance values may be presented between the rails. By varying the impedance presented to the rails by the shunt, the sensitivity of the track circuit may be determined and appropriate adjustments or calibrations made.

The shunt may be electrically connected to the rails of the track system in a variety of configurations. In some embodiments, the shunt is directly connected to the rails through appropriate wires or other conductors. By connecting the track shunt circuit directly to the rails, a break or failure of the shunt circuit at any location will prevent activation of the track activity detection circuit and indicate a fault in the system. In other embodiments, the shunt is electrically connected to the rails through the track activity detection circuit, such that the attachment to the rails is shared by both the track activity detection circuit and the track shunt circuit. In yet other embodiments, the shunt is electrically connected to the rails at an impedance coupler, to which the track activity detection circuit is also connected.

In some embodiments, a track system includes electrically isolated track sections separated by insulated joints. The use of insulated joints is well known and such joints may be used to define sections of track around certain locations, such as crossing or intersections. The system may include a second shunt (second track shunt circuit) electrically connected to the track system at a different location than the first shunt (first track shunt circuit) within a given track section. In one embodiment, the first shunt is electrically connected to the rails adjacent one end of a track section, and the second shunt is electrically connected to the rails adjacent the other end of the track section. In this configuration, the shunts may be operated independently, to simulate a train entering the track section from either end, to test the performance of the track activity detection circuit. In yet other embodiments, additional shunts may be provided at designated locations throughout a track section, such as at a mid-point of the section or at a location which is at a maximum distance from the location where a track activity detection circuit connects to the rails.

In embodiments, the system further includes a controller and a communications interface. The controller may be in communication with both the track activity detection circuit and the at least one track shunt circuit in order to direct operation of each component of the system. The controller may be locally operable allowing onsite personnel to operate the system to test the track circuit. In addition, the controller may receive instructions from a remote operator through the communications interface. In embodiments, the communications interface provides two-way communication with a remote operator, which may be an automated system. The communications interface may communicate over a wired or wireless connection, including a telephone network, cellular network, or wireless network.

In an embodiment, the controller is configured to operate the track shunt circuit to electrically connect or disconnect the first rail from the second rail in response to instructions received from an operator (e.g., located at a remote location). The controller is also configured to adjust the track activity detection circuit in response to calibration instructions. The calibration instructions may include adjusting the sensitivity or other parameters of the track activity detection circuit to maintain the desired operation. The controller is further operable to receive information on the status of the track activity detection circuit, including the status of whether a vehicle is detected on the track system.

In another embodiment, the communications interface is operable to receive instructions from a remote operator to control the track shunt circuit. In this manner, the track shunt circuit may be controlled without requiring on-site personnel. In embodiments, the communications interface also communicates the status of the track activity detection circuit to the remote operator. The status may include whether the presence of a vehicle is detected (whether because of an actual vehicle or the activation of the shunt). The status may also include other parameters of the track detection circuit that are detectable by the controller, such as a diagnostic signal or any fault indications. In yet further embodiments, the communications interface is operable to receive instructions to calibrate the track activity detection circuit. Calibration may be required as a result of changes in the circuit, or changes in external conditions. Examples of external conditions include environmental conditions, such as temperature or precipitation, which may alter the impedance of the rails or wires connecting the rails to the signal room.

In some embodiments, the remote operator is an automated track testing system. In embodiments, an automated track testing system includes instructions to implement methods for testing and/or calibrating the track circuit. Embodiments of the track testing system are also contemplated in which the methods may be performed in a semi-automated fashion with some or all steps being manually controlled by an operator.

In one embodiment, the track testing system issues an instruction to electrically connect a first rail to a second rail of a track system. The instruction is received at a controllable track shunt circuit, either directly or through one or more of a communications interface and controller. The controllable track shunt circuit automatically establishes an electrical connection between the first rail and the second rail in response to the instruction that is received. Once the electrical connection between the rails is established by the controllable track shunt circuit, the track activity detection circuit automatically detects the connection between the rails and identifies the track as occupied. Depending upon the track section being tested, crossing gates, warning lights and/or train control signals may be activated in response. Once the track activity detection circuit detects that the track is occupied based upon connection of the shunt, the track shunt circuit is controlled to disconnect the shunt and the track activity detection circuit detects that the track is no longer occupied. In some embodiments, the time required to connect the shunt, detect the occupied status, disconnect the shunt, and detect the unoccupied status may be sufficiently limited that related systems (e.g. crossing gates, lights) are not activated, allowing testing of the system with little or no impact on other users or traffic. If the track activity detection circuit is unable to detect the electrical connection between the rails when the track shunt circuit has been controlled to connect the shunt, the system may register a fault allowing appropriate actions to be taken which may include scheduling maintenance or in some instances closing the track section until further testing and repairs are completed.

In other embodiments, the track testing system automatically adjusts the track activity detection circuit in response to the detected electrical connection between the first rail and the second rail. As previously discussed, the track activity detection circuit may be adjusted or calibrated within limits to ensure proper detection of the occupancy status of the track system. In one embodiment, the track testing system uses a variable impedance shunt to calibrate the track activity detection circuit. For example, the track activity detection circuit is used to detect a first electrical connection between the rails when the shunt is controlled to have a first impedance. The impedance of the shunt is then changed to a second impedance, and the track activity circuit detects a second electrical connection between the rails when the shunt has the second impedance. In addition or alternatively, in some embodiments, the track testing system automatically adjusts the track activity detection circuit based upon a difference between the detected electrical connections with the shunt at the first impedance and the second impedance. In another embodiment, the system may vary the impedance of the shunt until the track activity detection circuit no longer detects that the track system is occupied, thus defining a range of impedance over which the track activity detection circuit is operable. If the range of operation is insufficient or changes, preventative maintenance for the track detection circuit may be scheduled. A determination of the sensitivity of the track activity detection circuit may be made in this manner, enabling adjustments and preventative maintenance not possible with prior art techniques.

In yet another embodiment, the track testing system is configured to automatically generate instructions to electrically connect the first rail to the second rail of the track system in response to a predetermined monitoring schedule.

Due to the remote operation capability and the ease of use of the presently disclosed system, the schedule for monitoring track circuits may be significantly increased with minimal cost, allowing for more frequent testing and early identification of changes or deterioration in the track circuit. In another embodiment, the track testing system automatically monitors local environmental conditions, such as temperature and humidity. The track monitoring system may automatically generate instructions, either locally or from a remote operator, to electrically connect the first rail to the second rail of the track system in response to a detected change in the monitored environmental conditions. In still yet other embodiments, the track testing system may automatically generate instructions to electrically connect the first rail to the second rail of the track system in response to operational information relating to the track system, such as the number of trains to have passed, the time since the last train occupied the track, or in advance of a scheduled arrival of a train based on an accessible track schedule.

Referring now to FIGS. 1-5, specific embodiments of the track circuit testing system are illustrated. As shown in FIG. 1, a track system 10 includes a first rail 12 and a second rail 14. The track system 10 is divided into electrically isolated track sections separated by insulating joints 16. At crossings and junctions within the track system, a signal room 18 (or similar wayside equipment room) may be located in close proximity to the track. A track activity detection circuit includes track circuit equipment 20 housed in the signal room 18, which is connected to the first rail 12 by connection 22 and to the second rail 14 by connection 24. When a train enters the track section at either end, the vehicle axle completes the circuit between rail 12 and rail 14 enabling the track activity detection circuit to detect the presence of the vehicle and identify the track section as occupied. As previously discussed, the track activity detection circuit may include a vital relay that is configured to be in its non-operative state when the first rail is electrically connected to the second rail by the vehicle axle.

The system further includes a track shunt circuit that includes a shunt control system 30 in communication with shunt device 32. The shunt device 32 is electrically connected to first rail 12 by connection 34 and to second rail 14 by connection 36. In one embodiment, shunt device 32 includes a relay that is controllable by shunt control system 30. By closing the relay, the shunt device forms an electrical connection between rail 12 and rail 14. The shunt device 32 thus provides a simulation of the electrical connection formed between the rails by a vehicle axle. In an embodiment, the shunt has a fixed impedance value which may be no less than 0.06 ohms. In other embodiments, the shunt may have an adjustable or controllable impedance. Although the system illustrated in FIG. 1 has a single track activity detection circuit and a single track shunt circuit, other configurations are also contemplated.

Figure 2:
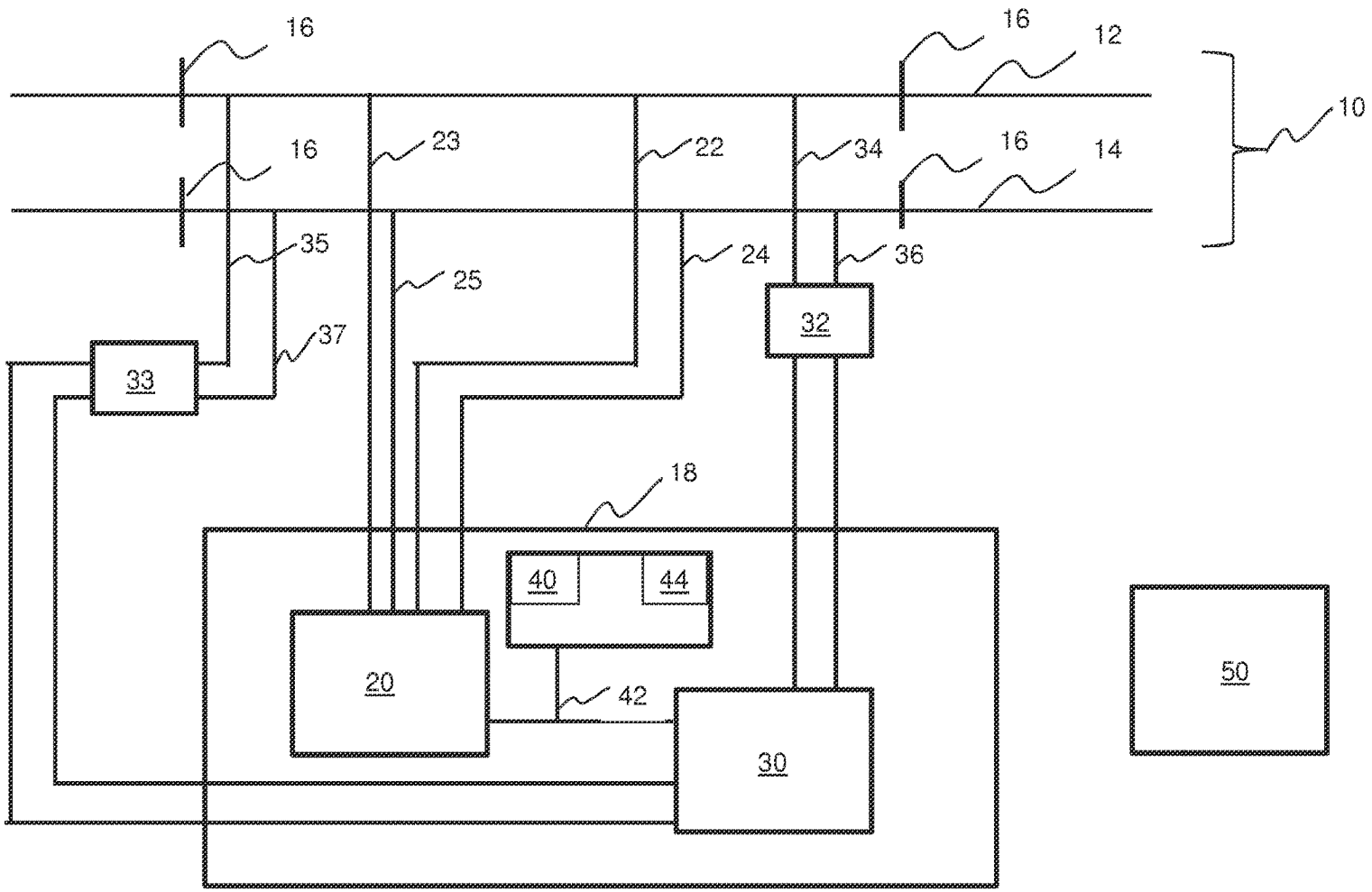
FIG. 2 is a schematic view of another embodiment of a track circuit testing system.

Referring now to FIG. 2, another embodiment of the system is illustrated with multiple shunt devices connected to the track system 10. As previously discussed, the track system 10 includes a first rail 12 and a second rail 14, and is divided into track sections separated by insulating joints 16. In this embodiment, the track circuit equipment 20 of the track activity connection circuit is connected to the track system at a first location by connections 22, 24 and at a second location by connections 23, 25. The track circuit detection circuit may detect the occupancy of the track section based upon either of these connections providing detection at both ends of the section and redundancy in the system.

In this embodiment, the system includes a second shunt device 33 connected to the first rail and the second rail by connections 35 and connection 37, respectively. The first shunt device 32 is connected to the rails adjacent one end of the track section, while the second shunt device 33 is connected to the rails adjacent the opposite end of the track section. In this manner, the track system 10 may be remotely shunted at either end in order to test the track activity detection circuit's response to electrically connecting the rails at either end of the track section. As illustrated, both the first shunt device 32 and the second shunt device 33 are controlled by the same shunt control system 30. In other embodiments, separate shunt control systems may be used for each shunt device, or alternatively, the shunt devices may be integrated into the shunt control system.

Figure 3:
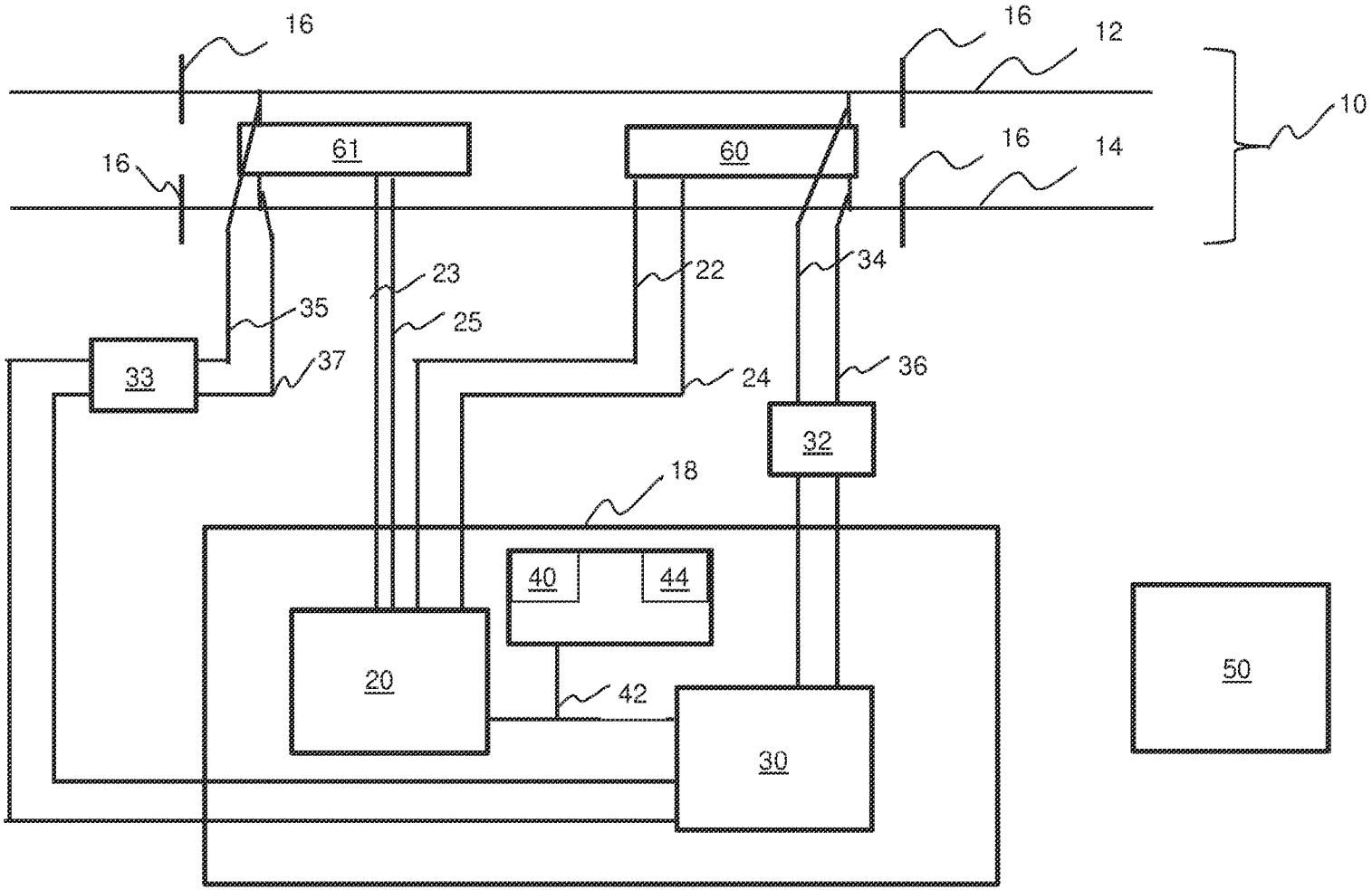
FIG. 3 is a schematic view of another embodiment of a track circuit testing system.

Referring now to FIG. 3, another embodiment of the system is illustrated in which the track activity detection circuit and the track shunt circuit are each connected to an impedance coupler. The track system 10 includes a first rail 12 and a second rail 14, and is divided into track sections separated by insulating joints 16. The track system further includes impedance couplers connected to the rails, which provide for connections to other circuits as described below. The track circuit equipment 20 of the track activity detection circuit is connected by connections 22 and 24 to the first impedance coupler 60. The impedance coupler 60 is in turn connected to the first rail 12 and the second rail 14, establishing the connection between the track activity detection circuit and the rails. The shunt control system 30 is connected to shunt device 32, which is in turn connected to impedance coupler 60 by connections 34 and 36, establishing the connection between the track shunt circuit and the rails. By operating the shunt device, an electrical connection is made between the first rail and the second rail using the shunt, allowing the track activity detection circuit and the impedance coupler to be tested. Like the system illustrated in FIG. 2, the system illustrated in FIG. 3 includes a second connection between the track circuit equipment 20 and the rails with connections 23, 25 to a second impedance coupler 61. The shunt control system 30 is similarly connected to a second shunt device 33, which is connected to the rails through connections 35, 37. The track activity detection circuit and the track shunt circuit are thus each connected to the rails of the track system adjacent each end of the track section. In other embodiments, the track activity detection system and the track shunt circuit may be connected to the rails at other locations, such as the mid-point of a track section.

Figure 4:
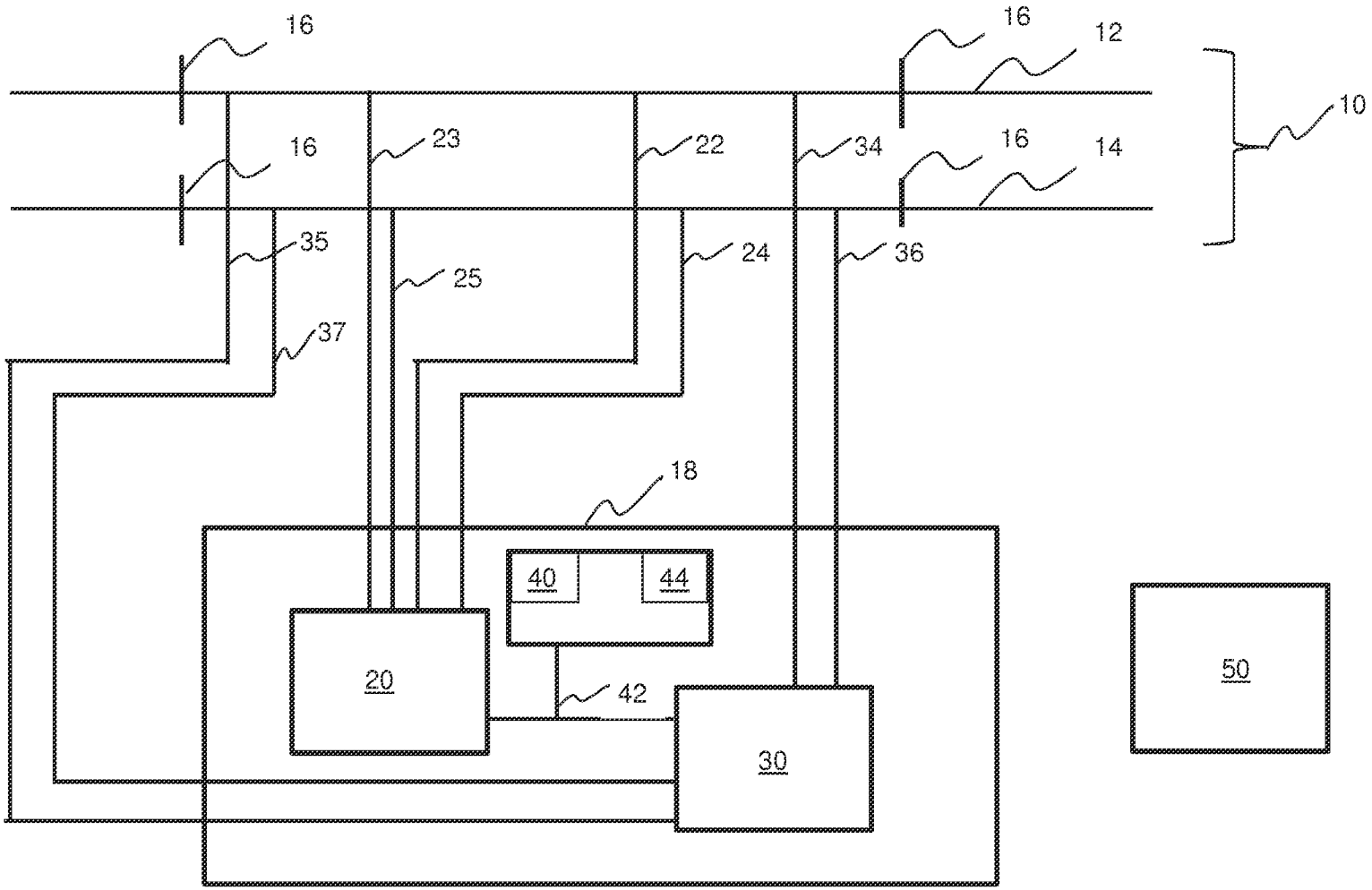
FIG. 4 is a schematic view of another embodiment of a track circuit testing system.

Referring now to FIG. 4, another embodiment of the system is illustrated in which the shunt device is integral with the shunt control system 30. The track system 10 includes a first rail 12 and a second rail 14, and is divided into track sections separated by insulating joints 16. As in previous embodiments, the track circuit equipment 20 of the track activity connection circuit is connected to the track system at a first location by connections 22, 24 and at a second location by connections 23, 25.

In this embodiment, the shunt control system 30 includes a shunt device such as a relay and is connected to the first rail and the second rail by connections 34, 36. Due to the impedance added by wiring between the shunt device and the rails, the location of the shunt device and the impedance introduced between the rails are related. Positioning the shunt device within a signal room 18 (as shown in FIG. 4) may increase the impedance associated with the connections 34, 36 due to the additional length of wiring necessary to extend from the signal room to the rails. The additional impedance of the connections 34, 36 may be negligible and/or maybe offset by adjusting the impedance of the shunt device within the shunt control system 30. In other embodiments, a shunt device separate from the shunt control system may be located within a signal room and connected to the rails as illustrated in the previous figures.

Figure 5:
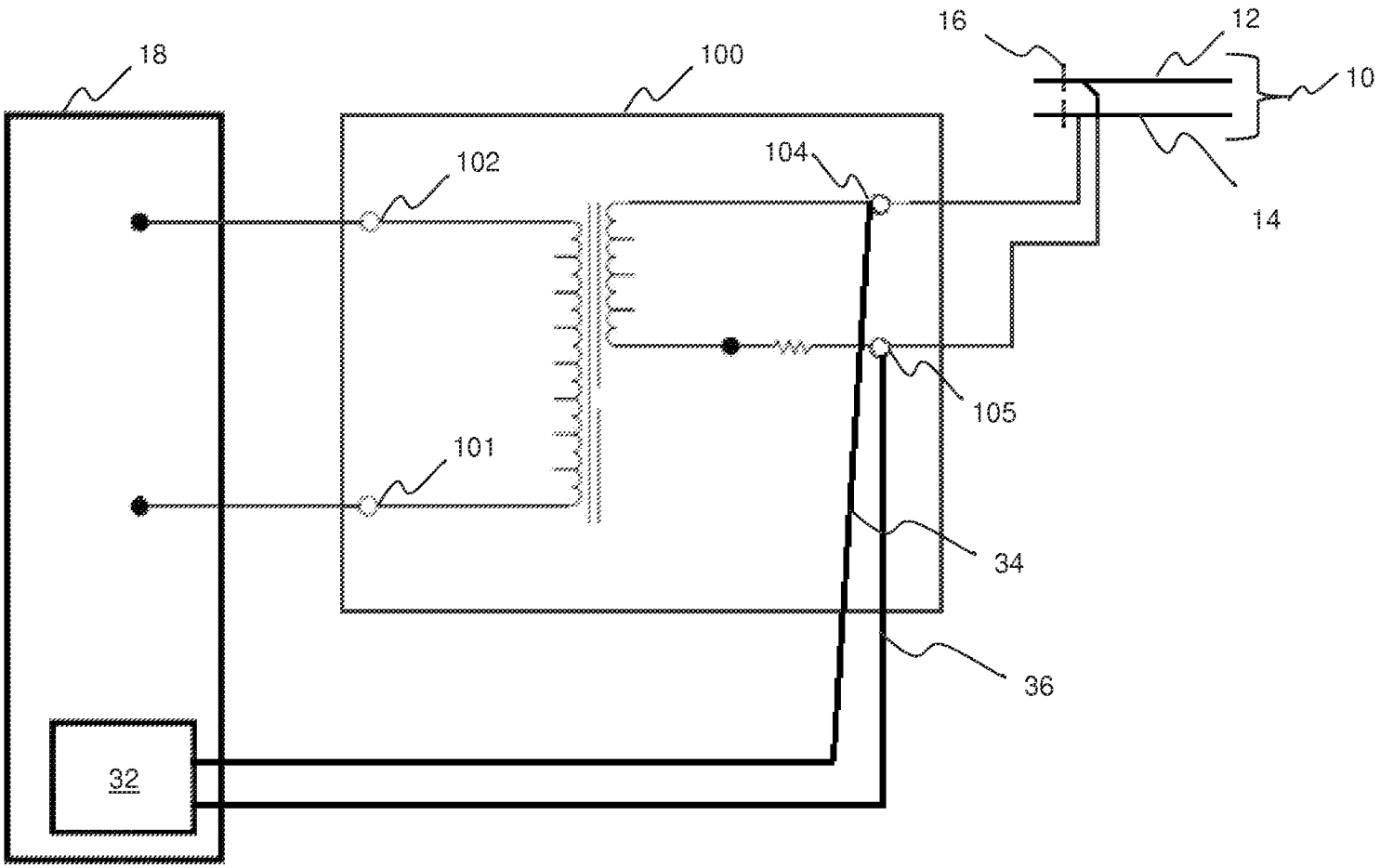
FIG. 5 is a schematic view of another embodiment of a track circuit testing system.

Referring now to FIG. 5, another embodiment of the system is illustrated in which the remote shunt device is electrically connected to the first rail and the second rail through the track activity detection circuit as shown. The track wires of the track activity detection circuit exit the signal room 18 and connect to a transformer 100 on an input side through connections 101, 102. The output side of the transformer 100 has connections 104, 105 which are connected to the rails 12, 14 of the track system 10, respectively. In this manner, the track activity detection circuit is connected to the first rail and the second rail as previously described. A shunt device 32, which in this embodiment is positioned in the signal room, is connected to the output side of transformer 100 at connections 104, 105. By operating shunt device 32, a shunt is created between connections 104, 105, simulating a vehicle axle electrically connecting the rails 12, 14. In this manner, remote testing and calibration of the track activity detection circuit is enabled.

In each of the previously discussed embodiments, the system also includes communications interface 40 connected to the track circuit equipment 20 and the shunt control system 30 through a communication link 42. The communication interface 40 in various embodiments provides both local and remote control over the track activity detection circuits and track shunt circuits. In some embodiments, the system includes a controller 44 in communication with the communication interface 40, and configured to operate the track shunt circuits to electrically connect or disconnect the first rail from the second rail in response to instructions received from an operator. In other embodiments, the system may include controller 44 without communication interface 40. The communications interface 40 communicates with a remote operator 50, which may be an automated track testing system as previously discussed. In other embodiments, the remote operator 50 is a user controlling the system by communicating instructions to the system over communications interface 40, which, through the controller 44, result in operation of the track shunt circuits and track activity detection circuits.

In another embodiment, a system (e.g., track circuit testing system) includes a track activity detection circuit and at least one track shunt circuit. The track activity detection circuit is electrically connected to first and second rails of a railroad track system, e.g., the rails are rails that the wheels of a rail vehicle engage for travel of the rail vehicle along a route defined by the rails. The track activity circuit is configured to detect the presence of a vehicle, such as a train, on the track system. The track shunt circuit is electrically connected to the first and second rails. The track shunt circuit is configured to selectively electrically connect the first rail to the second rail through a shunt, responsive to receiving a first control signal from a remote location. Thus, in a first state of operation, the first and second rails are not electrically connected by the shunt of the track shunt circuit, and in a second state of operation, responsive to receiving the first control signal, the track shunt circuit causes the first and second rails to be electrically connected to one another by the shunt of the track shunt circuit. The track shunt circuit may be configured to selectively electrically disconnect the first rail from the second rail through the shunt, responsive to receiving a second control signal from the remote location. Thus, in a third state of operation, the first and second rails are electrically connected to one another by the shunt of the track shunt circuit, and then responsive to receiving the second control signal, the track shunt circuit causes the shunt to no longer electrically connect the first and second rails.

In another embodiment, a system (e.g., track circuit testing system) includes a track activity detection circuit and at least one track shunt circuit. The track activity detection circuit is electrically connected to first and second rails of a railroad track system, e.g., the rails are rails that the wheels of a rail vehicle engage for travel of the rail vehicle along a route defined by the rails. The track activity circuit is configured to detect the presence of a vehicle, such as a train, on the track system. The track shunt circuit is electrically connected to the first and second rails. The track shunt circuit is configured to selectively establish a first impedance between the first rail and the second rail through a shunt, responsive to receiving a first control signal from a remote location. Thus, in a first state of operation, the first and second rails are not electrically connected by the shunt of the track shunt circuit, or are electrically connected at a second impedance level, and in a second state of operation, responsive to receiving the first control signal, the track shunt circuit controls the shunt to establish the first impedance between the first and second rails, where the first impedance is less than the second impedance, or less than the impedance between the rails in a non-electrically connected state, as applicable.

In another embodiment, a system comprises a track activity detection circuit electrically connected to each of a first rail and a second rail of a track system, and a track shunt circuit connected (e.g., electrically connected) to the first and second rails. The track shunt circuit comprises a shunt control system and a shunt device. The shunt control system is configured, responsive to receiving a control signal from a remote location, to automatically control the shunt device for transitioning from a first operative state, in which the first rail is not electrically connected to the second rail through the shunt device, to a second operative state, in which the first rail is electrically connected to the second rail through the shunt device. The system may further comprise a controller (operably coupled to at least one of the track activity detection circuit or the track shunt circuit) that is configured to determine when the track activity detection circuit detects that the first and second rails are electrically connected by the shunt device, for assessing whether the track activity detection circuit is operating correctly.

Although embodiments are characterized herein as including track activity detection circuits, in a more general embodiment, a system comprises a track shunt circuit configured to be electrically connected to first and second rails of a track system. The track shunt circuit comprises a shunt control system and a shunt device. When the track shunt circuit is installed for electrical connection to the first and second rails, the shunt control system is configured, responsive to receiving a control signal from a remote location, to automatically control the shunt device for transitioning from a first operative state, in which the first rail is not electrically connected to the second rail through the shunt device, to a second operative state, in which the first rail is electrically connected to the second rail through the shunt device. The track shunt circuit may be used in conjunction with a track activity detection circuit and controller, for the controller to determine when the track activity detection circuit detects that the first and second rails are electrically connected by the shunt device, for assessing whether the track activity detection circuit is operating correctly.

As should be appreciated, in embodiments, the shunt device of the track shunt circuit: is separate from, and does not utilize any part of, any vehicles passing along the tracks (e.g., the shunt device does not include or utilize an axle of any passing vehicle); and/or does not include or utilize a structural member that carries the load of a passing vehicle, other than the shunt device, in one mode of operation, electrically connecting the first and second rails (e.g., the shut device does not include or utilize a rail switch that is used to transition a rail vehicle from one track to another). In other embodiments, the track shunt circuit is configured to not actuate to electrically connect the first and second rails, whenever a vehicle is present in a block of the track shunt circuit; and/or a controller or other device that issues control signals to control the track shunt circuit is configured to not actuate the track shunt circuit to electrically connect the first and second rails, whenever a vehicle is present in a block of the track shunt circuit. In another embodiment, actuation of the track shunt circuit to electrically connect the first and second rails is not responsive to the presence of a vehicle at the track shunt circuit or in a block of the track shunt circuit (i.e., actuation is responsive to factors other than a vehicle being present).

Embodiments of the presently disclosed system and method provide for remote testing and calibration of track circuits, including automated testing, in ways not possible with prior systems resulting in improved reliability and reduced operating costs for railroad owners and operators.

In the specification and claims, reference will be made to a number of terms that have the following meanings. The singular forms "a", "an" and "the" include plural referents unless the context clearly dictates otherwise. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Similarly, "free" may be used in combination with a term, and may include an insubstantial number, or trace amounts, while still being considered free of the modified term. Moreover, unless specifically stated otherwise, any use of the terms "first," "second," etc., do not denote any order or importance, but rather the terms "first," "second," etc., are used to distinguish one element from another.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be." The term "instructions" as used herein may refer to computer executable instructions.

This written description uses examples to disclose the invention, including the best mode, and also to enable one of ordinary skill in the art to practice the invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not different from the literal language of the claims, or if they include equivalent structural elements with insubstantial differences from the literal language of the claims.

What is claimed is:

1. A system comprising:

a track activity detection circuit electrically connected to each of a first rail and a second rail of a track system; and at least one track shunt circuit connected to the first and second rails through the track activity detection circuit, wherein the at least one track shunt circuit is configured to selectively electrically connect the first rail and the second rail through a shunt.

2. The system of claim 1, wherein:

the track system includes an electrically isolated track section having a first end and a second end; and wherein the at least one track shunt circuit comprises a first track shunt circuit connected through the track activity detection circuit to the first rail and the second rail adjacent the first end of the track section and a second track shunt circuit connected through the track activity detection circuit to the first rail and the second rail adjacent the second end of the track section.

3. The system of claim 1, wherein the track activity detection circuit is configured to detect vehicle presence on the track system by detecting an electrical connection between the first rail and the second rail.

4. The system of claim 1, wherein the track activity detection circuit comprises a vital relay.

5. The system of claim 1, wherein the track activity detection circuit comprises a vital relay configured to be in a non-operative state when the first rail is electrically connected to the second rail by a vehicle axle.

6. The system of claim 1, wherein the at least one track shunt circuit comprises a relay.

7. The system of claim 1, wherein the at least one track shunt circuit is electrically connected with the track activity detection circuit, the first rail, and the second rail in one or more locations between the track activity detection circuit and the first and second rails.

8. The system of claim 1, wherein the at least one track shunt circuit is electrically connected to the first rail and the second rail at the same connections between the track activity detection circuit and the first and second rails.

9. The system of claim 1, wherein the shunt has a fixed impedance.

10. The system of claim 1, wherein the shunt has an impedance no less than 0.06 ohms.

11. The system of claim 1, wherein the shunt has an adjustable impedance.

12. The system of claim 1, further comprising: a controller configured to operate the at least one track shunt circuit to electrically connect or disconnect the first rail from the second rail in response to a received instruction.

13. The system of claim 12, wherein the controller is configured to adjust the track activity detection circuit in response to calibration instructions.

14. The system of claim 1, further comprising: a communications interface operable to receive a first instruction and to control the at least one track shunt circuit in response to the first instruction that is received.

15. The system of claim 14, wherein the communications interface is further operable to at least one of communicate track activity detection status to a remote location or receive a second instruction to calibrate the track activity detection circuit.

16. The system of claim 14, wherein the first instruction is received from an automated track testing system.

17. The system of claim 1, wherein the shunt is remotely located from the first and second rails such that the shunt is not located between the first and second rails.

18. The system of claim 1, wherein the track activity detection circuit is electrically connected to the first and second rails via a transformer, and wherein the at least one track shunt circuit is connected with the track activity detection circuit and the first and second rails in one or more locations between the transformer and the first and second rails.

19. A system comprising:

a track activity detection circuit electrically connected to each of a first rail and a second rail of a track system; and a track shunt circuit connected to the first and second rails by the track activity detection circuit, the track shunt circuit comprising a shunt control system and a shunt device, wherein the shunt control system is configured, responsive to receiving a control signal from a remote location, to automatically control the shunt device for transitioning from a first operative state, in which the first rail is not electrically connected to the second rail through the shunt device, to a second operative state, in which the first rail is electrically connected to the second rail through the shunt device.

20. The system of claim 19 further comprising a controller operably coupled to at least one of the track activity detection circuit or the track shunt circuit and configured to determine when the track activity detection circuit detects that the first and second rails are electrically connected through the shunt device.

21. A system comprising:

a track shunt circuit configured to be electrically connected to first and second rails of a track system through a track activity detection circuit, the track shunt circuit comprising a shunt control system and a shunt device, wherein the shunt control system is configured, responsive to receiving a control signal from a remote location and when the track shunt circuit is installed for electrical connection to the first and second rails, to automatically control the shunt device for transitioning from a first operative state, in which the first rail is not electrically connected to the second rail through the shunt device, to a second operative state, in which the first rail is electrically connected to the second rail through the shunt device.

* * * * *